US006846053B2

(12) United States Patent
Salice

(10) Patent No.: US 6,846,053 B2
(45) Date of Patent: Jan. 25, 2005

(54) GREASE-DAMPENED DRAWER CLOSING APPARATUS

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 10/631,345

(22) Filed: Jul. 31, 2003

(65) Prior Publication Data

US 2004/0021406 A1 Feb. 5, 2004

Related U.S. Application Data

(62) Division of application No. 09/853,861, filed on May 11, 2001, now Pat. No. 6,629,738.

(30) Foreign Application Priority Data

Sep. 19, 2000 (IT) ..... MI20000527 U

(51) Int. Cl.[7] ..... A47B 88/00
(52) U.S. Cl. ..... 312/334.14
(58) Field of Search ..... 312/334.1, 334.6, 312/334.14, 334.16, 334.27, 334.29, 334.31, 334.32, 334.36, 334.33, 334.44, 334.34, 319.1, 333; 384/20, 21

(56) References Cited

U.S. PATENT DOCUMENTS 5,364,179 A * 11/1994 Brustle et al. ..... 312/333
5,474,375 A * 12/1995 Hollenstein et al. ..... 312/319.1
5,580,138 A * 12/1996 Grabher ..... 312/319.1
6,007,036 A * 12/1999 Rosen
6,340,078 B1 * 1/2002 Scheible ..... 188/166
6,736,471 B2 * 5/2004 Lin ..... 312/333

FOREIGN PATENT DOCUMENTS

| | | |
|---|---|---|
| DE | 43 28 502 | * 3/1994 |
| DE | 29821364 | 3/1999 |
| DE | 29913854 | 11/1999 |
| DE | 19835466 | 2/2000 |
| DE | 29916841 | 2/2000 |
| DE | 20010282 | 5/2000 |
| EP | 741984 | * 11/1996 |
| EP | 743032 | * 11/1996 |
| JP | 3756 A | * 3/2001 |

* cited by examiner

*Primary Examiner*—Janet M. Wilkens
(74) *Attorney, Agent, or Firm*—Herbert Dubno

(57) ABSTRACT

A closing device for sliding portions of pieces of furniture, such as drawers and the like, consisting of a container fastened to the fixed or to the sliding portion of the piece of furniture wherein there are housed a mechanical energy accumulator and an actuation member that is sliding into a guide of the container, and of a pulling member, respectively fastened to the other side of the piece of furniture, which interacts with the actuation member. The actuation member is directly or indirectly slowed in its movement by a deceleration device based on the use of high-viscosity greases.

7 Claims, 5 Drawing Sheets

2
5
3
4
3
A
10
1
6
11

6
19
13
14
18
C
11
9
15
7
19
7
17
16

20
19
14
21
13
7

1
8
8

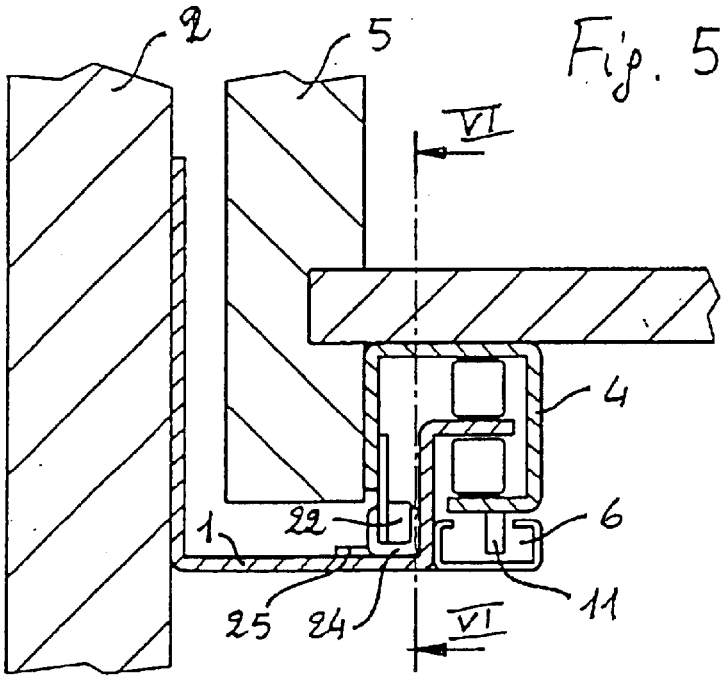
Fig. 5
Fig. 6
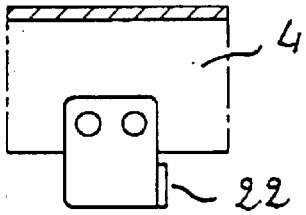
Fig. 7
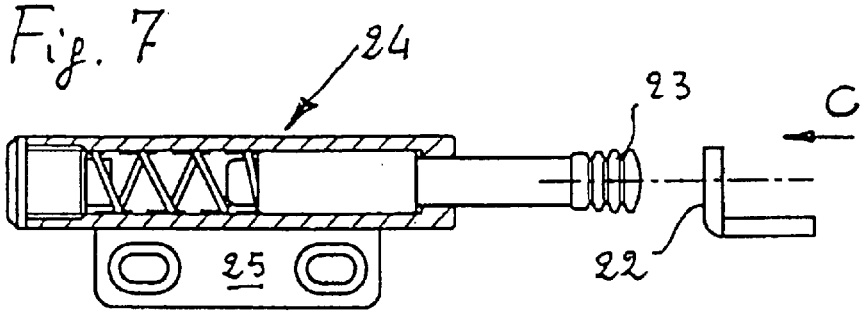

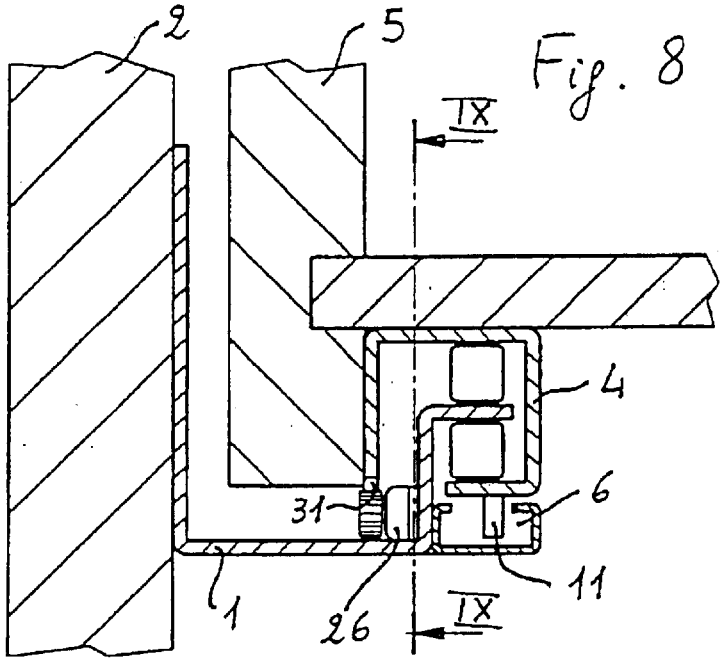
Fig. 8
Fig. 9
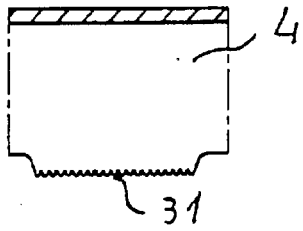
Fig. 10
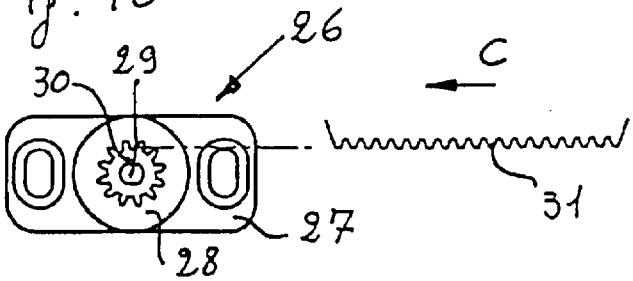

GREASE-DAMPENED DRAWER CLOSING APPARATUS

CROSS REFERENCE TO RELATED APPLICATIONS

This application is a division of Ser. No. 09/853,861 filed 11 May 2001 (now U.S. Pat. No. 6,629,738 of 7 Oct. 2003) and corresponds to Italian application MI 2000 U 000527 filed 19 Sep. 2000 under the Italian Convention.

FIELD OF THE INVENTION

The invention relates to a closing device for sliding portions of pieces of furniture, such as drawers and the like, consisting of a housing fastened to the fixed or to the sliding portion of the piece of furniture, a mechanical energy accumulator, an actuation member that slides in a guide of the housing, and a pulling member that is fastened to the other portion of the piece of furniture and that interacts with the actuation member.

BACKGROUND OF THE INVENTION

Closing devices mounted on guides for drawers or to hinges for pieces of furniture are known, having deceleration systems for damping the speed of the portions of pieces of furniture just before they reach their closed position, so as to prevent annoying shocks and noise.

DE 198 35 466 discloses a deceleration device for drawers or the like, consisting of a housing with a mechanical energy accumulator and of a sliding actuation member interacting with a pulling pin housed at the other side of the piece of furniture, where between the energy accumulator and the actuation member there is interposed a deceleration device connected to the latter so as to increase friction when it is pushed by the same pulling pin.

Known deceleration devices exhibit a complex structure and also require a high precision of implementation. They are therefore relatively expensive.

OBJECT OF THE INVENTION

Thus, the object of the invention is to create a closing device of the previously described type which has a cost-effective deceleration system that is easy to implement.

SUMMARY OF THE INVENTION

According to the invention, this object is achieved in a first embodiment, in that the movement of the actuation member of the closing system is directly or indirectly slowed by a high-viscosity grease.

The grease used according to the invention is a known damping grease and can consist of high-viscosity base oils, of a tackifier polymer and of synthetic hydrocarbons having a very high viscosity so as to provide a high resistance to motion.

According to a preferred embodiment, the high-viscosity grease is mounted on a guide wall of the housing so as to exert its damping or decelerating function in the space between the walls of the guide and the actuation member sliding inside it.

According to another embodiment of the invention, the actuation member has a projecting part sliding in a special guide of the housing provided with grease.

The walls of the housing guide can be suitably provided with small projecting parts or grooves that prevent undesired movement of the grease.

As an alternative or in addition to the guide walls, the walls of the actuation member can also be provided with grooves or surface irregularities.

DE 299 13 854 discloses a deceleration device consisting of a piston that slides in a cylinder against the force of an ejection spring, where high-viscosity grease is mounted on the cylinder walls.

DE 298 21 364 discloses a deceleration device consisting of toothed rods sliding in a housing and engaging a toothed wheel connected to the shaft of a rotation decelerator containing high-viscosity oil or grease.

These known deceleration devices are separate parts that can be autonomously mounted on the fixed and sliding portions of pieces of furniture.

A further embodiment of the invention provides for the high-viscosity grease to be in a second housing, such as for example a decelerator of the known type, inside which a piston slides or a propeller rotates. The piston or propeller are stressed by a member directly or indirectly connected to the pulling member of the closing device.

Similarly to this last embodiment, it is also possible to provide for the piston or propeller to be stressed by a member directly connected to the actuation member sliding in the guide of the housing of the closing device rather than to the pulling member.

In a preferred embodiment, the member consists of a bar pivoted on the actuation member and sliding in a longitudinal groove of the housing of the closing device through projecting guide strips. The bar is suitable held in the groove by a cover fastened to the housing and that at least partly covers it.

The closing device according to the invention is particularly adapted for the application to portions of pieces of furniture extendable from the body of the piece of furniture through sliding guides, such as for example drawers or the like. It consists of a housing fastened to one of the fixed or mobile portions of the guides, a mechanical energy accumulator, an actuation member sliding into a guide of the housing, and a pulling member fastened to the other portion of the sliding guides, which is stressed in the closing direction by the actuation member in the proximity of the introduced portion of the extendable portion of piece of furniture.

A deceleration system coupled to the closing device is provided by simply applying a deceleration device of known type on a side projecting part of the housing, which in the action zone of the closing device brakes a member integrally connected to the pulling member.

Such oil deceleration devices are known, for example, from DE 200 10 282.6, to which reference should be made for a more detailed description.

The decelerator can be fastened by a cover with inverted U-section that winds it up and is hooked through spring tabs at the edges of recesses arranged on the housing of the closing device. In order to allow the application on the guides both on the right and on the left of the drawer, the member consists of an angled plate which carries on one side the pulling pin and on the other side two parallel tabs protruding symmetrically with respect to the pulling pin.

BRIEF DESCRIPTION OF THE DRAWING

Some embodiments are illustrated hereinafter with reference to the attached drawings. In such drawings:

FIG. 5 shows a transverse section of a second embodiment of the closing device with a piston deceleration device;

FIG. 6 shows a section of the mobile guide taken along line VI—VI of FIG. 5;

FIG. 7 shows a longitudinal section of the deceleration device of FIG. 5 with its essential components;

FIG. 8 shows a transverse section of a third embodiment of the closing device with a rack and toothed-wheel deceleration device;

FIG. 9 shows a section of the mobile guide along line IX—IX of FIG. 8;

FIG. 10 shows a side view of the deceleration device of FIG. 8;

SPECIFIC DESCRIPTION

Figure 1:
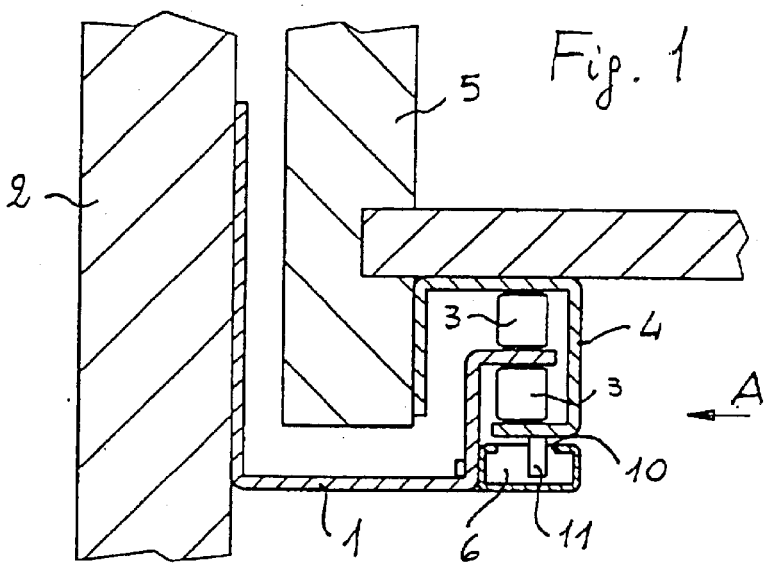
FIG. 1 shows a transverse section of the closing device according to the invention, mounted on a guide for a drawer.

FIG. 1 shows a possible arrangement of the closing device mounted on an extendable guide for a drawer. There is shown a fixed guide 1 screwed to a wall 2 of the piece of furniture, on which an extendable guide 4 screwed to a drawer 5 slides in a known manner via rollers or balls 3.

A housing 6 is mounted on the fixed guide 1 by hooks 7 that are locked into holes 8 of the fixed guide 1 by spring hooks 9. The housing 6 is below the extendable guide 4 and has an upper aperture or slot 10 inside which a pulling pin 11 projecting down from the extendable guide 4 can slide.

The closing device is known per se, and consists of the housing 6 forming a longitudinal chamber 13 inside which an actuation member 14 slides. Between a rear end of the actuation member 14 and a rear end of the chamber 13 there is stretched a helical spring 15 forming a mechanical energy accumulator when the actuation member 14 in its extended position is hooked by a formation 16 to the front edge 17 of the housing 6.

Figure 2:
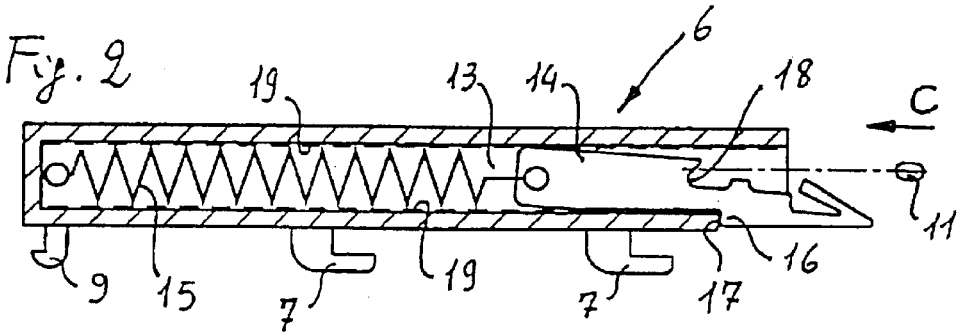
FIG. 2 shows a longitudinal section of the closing device with its essential components.

As can be seen in FIG. 2, when the drawer 5 is closed in the direction of arrow C, the pulling pin 11 enters into a recess 18 of the actuation member 14 and, through the effect of its inclined edge, unhooks the formation 16 so that the spring 15 exerts its tensile force and moves the member 14 back to close the drawer.

In the device according to the invention, along the walls of the longitudinal chamber 13 there is applied a high-viscosity grease layer 19 that limits the sliding speed of the actuation member 14, thus allowing a gentle closing of the drawer 5.

Figure 3:
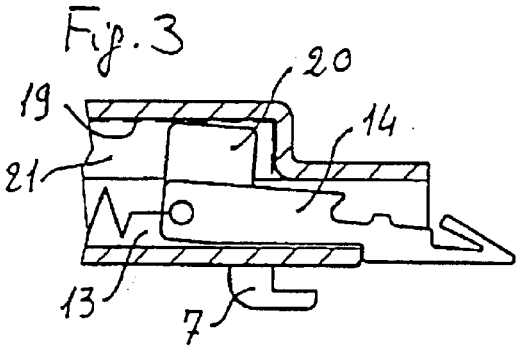
FIG. 3 shows a variant of the closing device according to FIG. 2.
Figure 4:
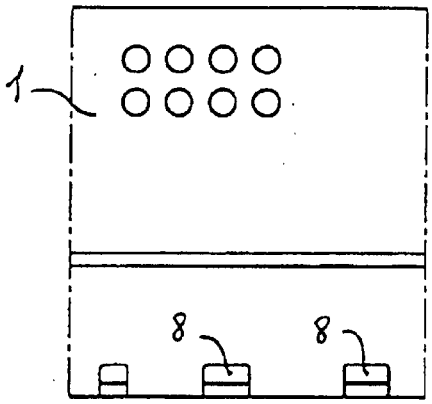
FIG. 4 shows a side view of a portion of the fixed guide taken in the direction of arrow A of FIG. 1.

In the partial view of FIG. 3, the actuation member 14 is provided with a projecting part 20 guided into a special side guide 21 of the housing 6, inside which there is applied the high-viscosity grease layer 19 so that it forms a suitable reservoir.

The walls of the longitudinal chamber 13 or of the side guide 21, as well as the side surfaces of the actuation member 14 or of the projecting part 20 can be provided with small bumps and grooves to prevent an undesired movement of the grease of the layer 19.

The embodiment of FIG. 5 corresponds to that of FIG. 1 described above, with the exception that the housing 6 does not contain grease. Otherwise the same parts are indicated with the same reference numerals.

In a suitably selected position in relation to the position of the pulling pin 11, a bumper 22 is fastened to the extendable guide 4 and, during the closing motion of the drawer, it abuts against an elastic cap 23 of a standard piston-type decelerator 24 containing high-viscosity grease, for a better description of which reference can be made to DE 299 13 854. The decelerator 24 is illustrated in its essential components in FIG. 7. It has a side flange 25 by means of which it is fastened to the fixed guide 1.

The embodiment of FIG. 8 corresponds to that of FIG. 5, but the piston decelerator 24 is replaced with a standard rotating shaft decelerator 26 whose essential components are illustrated in FIG. 10. The decelerator 26 is connected to the fixed guide 1 by a flange 27 and consists of a cylindrical chamber 28 from which protrudes a shaft 29 on which a gear 30 is keyed. A rack 31 meshes with the gear 30 and is carried on a wall of the extendable guide 4 and arranged in a suitable manner with respect to the pulling pin 11. The cylindrical chamber 28 is filled with high-viscosity oil or grease. The shaft 29 carries helical vanes (not shown in FIG. 8) which create the decelerating effect when in contact with the grease.

Figure 11:
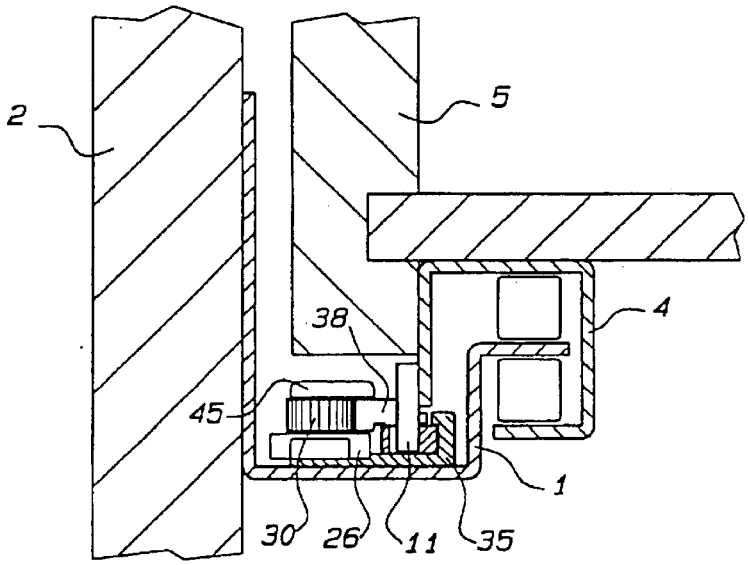
FIG. 11 shows a transverse section of a fourth embodiment of the closing device with a rack deceleration device directly connected to the actuation member.
Figure 12:
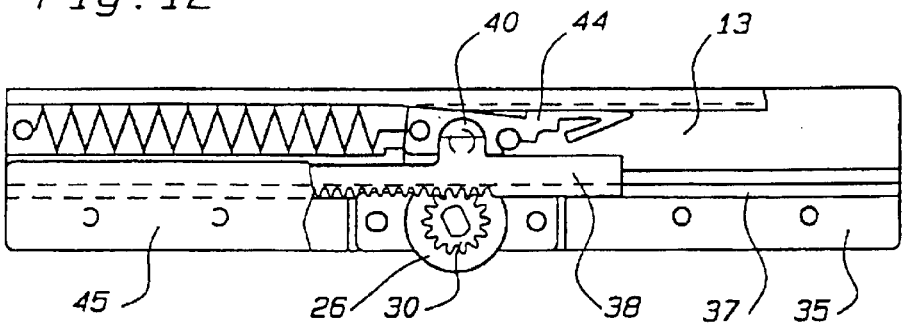
FIG. 12 shows a top, partly sectional view of the closing and deceleration device of FIG. 11.
Figure 13:
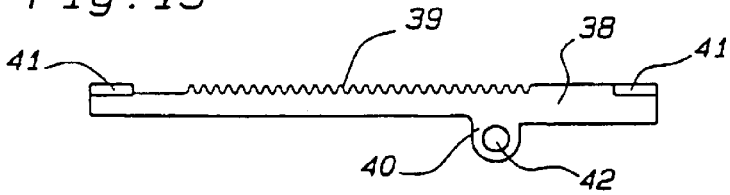
FIG. 13 shows a bottom view of the bar of the device of FIG. 12.
Figure 14:
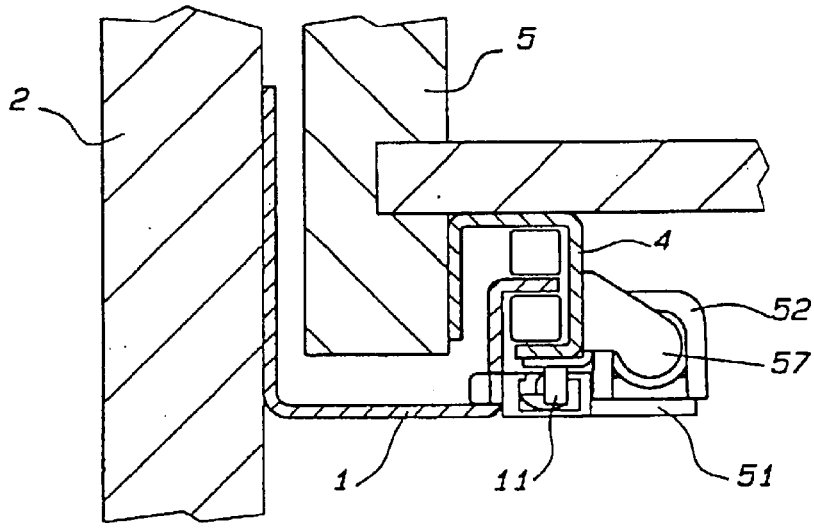
FIG. 14 shows a transverse section of a fifth embodiment of the closing device with an oil deceleration system and member integrally connected to the pulling member.
Figure 15:
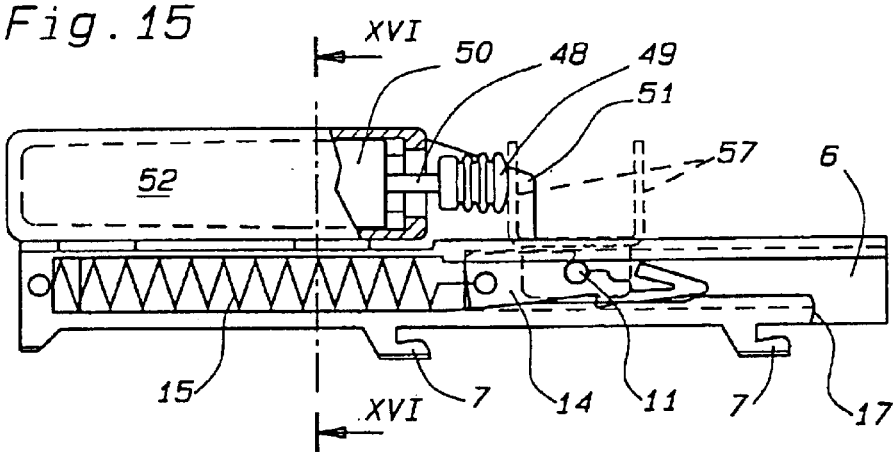
FIG. 15 shows a top, partly sectional view of the closing and deceleration device of FIG. 14.
Figure 17:
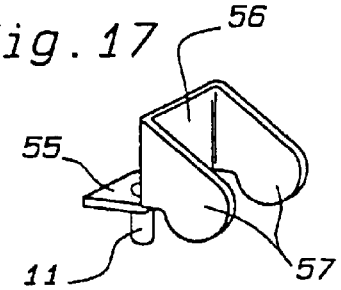
FIG. 17 shows a perspective view of the member directly connected to the pulling member.
Figure 16:
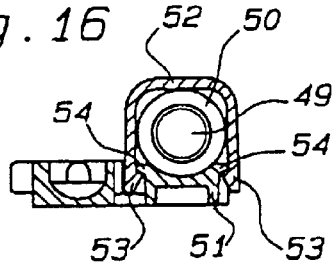
FIG. 16 shows a transverse section of the device of FIG. 15 taken along line XVI—XVI of FIG. 15.

In order to facilitate the correct reciprocal arrangement of the component parts, so as to perfectly coordinate the action of the closing device with that of the members that cause its deceleration, the embodiment of the invention according to FIGS. 11 to 13 has a gear decelerator 26 mounted on a housing 35 laterally adjacent a groove 37 along which the member consisting of a bar 38 provided with a rack 39 meshing with the gear 30 is guided. The groove 37 is parallel to the longitudinal chamber 13 inside which the actuation member 44 slides, and it houses guide strips 41 that protrude from the lower side of the ends of the bar 38. On a side projecting part 40, the bar 38 has a pin 42 that can be set in a hole of the actuation member 44 so that the two members 38 and 40 are connected in an oscillating manner with one another as shown in FIG. 12. The decelerator 26 and the bar 38 are held on the housing 35 by a cover 45 that covers them at least partly.

The decelerator 26 can suitably be of the unidirectional type that exerts its action only in the drawer introduction direction, without affecting its extension movement.

In the embodiment of the invention according to FIGS. from 14 to 17, a unidirectional oil deceleration device 50 of known type is used, which in its outside configuration corresponds to a cylinder from which a rod 48 of a piston protrudes, in turn provided with an elastic cap 49. The deceleration device 50 is mounted on a side projecting part 51 of the housing 4 of the closing device, which essentially corresponds in its constituting parts to the closing device of FIG. 2 and is similarly mounted on the fixed guide 1 of the drawer 5 by the side hooks 7. The decelerator 50 is held on the side projecting part 51 of the housing in a suitable position with respect to the actuation member 14 so that a member connected to the extendable guide 4 abuts against the elastic cap 49 soon after the pulling pin 11, in its closing movement, has released the actuation member 14 from the edge 17 of the housing 6.

The decelerator 50 is surrounded by a cover 52 having an inverted U-section that is hooked by spring tabs 53 at edges 54 on the housing of the closing device. The member fastened to the extendable guide 4 of the drawer or the like consists of a right angle plate 55, 56 on a leg 55 of which there is fastened the pulling pin 11, whereas on the other leg 56, two parallel tabs 57, arranged in a symmetrically spaced position with respect to the pulling pin 11, protrude perpendicularly so as to allow the application of the same plate both on the right and on the left guide of the drawer.

I claim:

1. A closing device for sliding portions of an article of furniture and comprising:

a container adapted to be fastened to a fixed or sliding portion of the article of furniture;

a mechanical energy accumulator received in said container;

an actuation member slidable in a guide of said container;

a pulling member interacting with the actuation member, the actuation member being slowed in movement by a high viscosity grease, said grease being received in a second container within which a piston slides or a propeller rotates, the piston or propeller being stressed by a contrast member directly or indirectly connected to said pulling member.

2. The closing device defined in claim 1 wherein said contrast member is directly connected to the actuation member and the actuation member slides in said guide of the closing device.

3. The closing device defined in claim 2 wherein said contrast member comprises a cursor pivoted on the actuation member and sliding in a longitudinal groove of said container of the closing device by means of protruding guiding strips.

4. The closing device according to claim 3 wherein the cursor is held in a said groove by a cover fastened to a said container and at least partly covering said groove.

5. A closing device for portions of pieces of furniture extractable from a body of the piece of furniture through sliding guides (1, 4), said closing device consisting of a container (6) adapted to be fastened to one of a fixed or a mobile portion of the guides, wherein there are housed a mechanical energy accumulator (15) and an actuation member (14) sliding into a guide of the container, and of a pulling member (11) respectively adapted to be fastened to the other side of the sliding guides, which is stressed in the closing direction by the actuation member in the proximity of the introduced portion of the extractable portion of piece of furniture, characterized in that on a side projecting part (51) of the container (6) there is applied an oil deceleration device (50) which in an action zone of the closing device brakes a contrast member (55, 56) integrally connected to the pulling member (11).

6. Closing device according to claim 5, characterized in that the decelerator device (50) is fastened through a cover (52) having upturned-U transversal section, that surrounds it, and is hooked through sprung tabs (53) to the edges (54) of recesses on the container (6) of the closing device.

7. Closing device according to claim 5, characterized in that the contrast member consists of an angled plate (55, 56) carrying on a side the pin (11) forming the pulling member and on the other side, two protruding parallel tabs (57) arranged in symmetrical position with respect to the pulling pin (11).

* * * * *